US006754934B1

(12) United States Patent
Shiffler

(10) Patent No.: US 6,754,934 B1
(45) Date of Patent: Jun. 29, 2004

(54) LOWER SURFACE STRUCTURE FOR FURNITURE CAP AND GLIDE

(75) Inventor: John Shiffler, Mentor, OH (US)

(73) Assignee: Shiffler Equipment Sales, Inc., Chardon, OH (US)

( * ) Notice: Subject to any disclaimer, the term of this patent is extended or adjusted under 35 U.S.C. 154(b) by 0 days.

(21) Appl. No.: 10/346,433

(22) Filed: Jan. 17, 2003

(51) Int. Cl.[7] ..... A47B 91/06
(52) U.S. Cl. ..... 16/42 R; 16/42 T
(58) Field of Search ..... 16/42 R; 472/88, 472/90; 248/188.9, 188.8, 346.11, 364.04

(56) References Cited

U.S. PATENT DOCUMENTS

| | | | | | |
|---|---|---|---|---|---|
| 2,301,385 | A | | 11/1942 | Ehrgott | |
| 2,836,843 | A | | 6/1958 | Gallagher | |
| 2,878,509 | A | | 3/1959 | Fisher | |
| 2,890,545 | A | * | 6/1959 | Fiddler | 248/188.4 |
| 2,902,794 | A | | 9/1959 | Ehrgott | |
| 2,919,514 | A | | 1/1960 | King | |
| 2,968,116 | A | | 1/1961 | Arenson | |
| 3,099,103 | A | * | 7/1963 | Wright | 248/188.8 |
| 3,213,963 | A | | 10/1965 | Vogt | |
| 3,326,508 | A | | 6/1967 | Born | |
| 3,333,805 | A | | 8/1967 | Marshall | |
| 3,641,620 | A | | 2/1972 | Hage | |
| 3,646,633 | A | | 3/1972 | Meinhardt | |
| 4,327,461 | A | | 5/1982 | Wisniewski | |
| 4,798,359 | A | | 1/1989 | Ball | |
| 5,010,621 | A | | 4/1991 | Bock | |
| 5,170,972 | A | | 12/1992 | Guell | |
| 5,191,676 | A | | 3/1993 | Gerner | |
| 5,220,705 | A | | 6/1993 | Bushey | |
| 5,287,595 | A | | 2/1994 | Stevens | |
| 5,426,818 | A | | 6/1995 | Bushey | |
| 5,465,430 | A | | 11/1995 | Davis | |
| 5,557,824 | A | | 9/1996 | Bushey | |
| D383,377 | S | | 9/1997 | Sellers | |
| 5,680,673 | A | | 10/1997 | Beshore | |
| 5,743,506 | A | * | 4/1998 | Adams | 248/346.11 |
| 5,802,669 | A | * | 9/1998 | Wurdack | 16/42 R |
| 5,820,217 | A | | 10/1998 | Horner | |
| 5,868,372 | A | * | 2/1999 | Novak et al. | 248/346.11 |
| 6,324,725 | B1 | * | 12/2001 | Green | 16/42 R |

FOREIGN PATENT DOCUMENTS

| | | | | |
|---|---|---|---|---|
| DE | 2407820 A | * | 3/1975 | A47B/91/12 |

* cited by examiner

*Primary Examiner*—Chuck Y. Mah
(74) *Attorney, Agent, or Firm*—Rankin, Hill, Porter & Clark LLP

(57) ABSTRACT

A furniture cap or glide that is secured to a leg of an article of furniture, wherein the cap or glide defines an axis and has a lower surface and a sidewall spaced from the axis. The lower surface has a plurality of inner protrusions, a plurality of outer protrusions, and a series of connectors extending therefrom. The outer protrusions extend from the lower surface a first predetermined distance. The inner protrusions extend from the lower surface a second predetermined distance, which is smaller than the first predetermined distance. The connectors extend between and interconnect the some of the inner and outer protrusions, and extend from the lower surface a third predetermined distance. Initially, the outer protrusions engage the floor surface but, as the cap wears from use, the inner and outer protrusions simultaneously engage the floor surface, and thereby provide objective visual indication that the cap has worn a first amount. Upon further wear, the protrusions and the connectors engage and slide across the floor surface, and thereby indicate that a second amount of wear has occurred.

14 Claims, 4 Drawing Sheets

LOWER SURFACE STRUCTURE FOR FURNITURE CAP AND GLIDE

BACKGROUND OF THE INVENTION

1. Field of the Invention

The present invention relates generally to furniture, and more particularly to furniture glides and caps.

2. Description of Related Art

Moving furniture across a floor surface can be problematic in that the furniture legs contacting the floor surface can scratch or gouge the floor surface during movement. Dirt and debris on the floor surface can build up in front of a moving furniture leg so as to increase the difficulty of the movement.

Devices, such as caps, glides, rollers and pads, are used to decrease the difficulty of moving furniture across a floor. The devices protect the floor from scratches or gouges by the moving floor legs. The devices also reduce friction between the furniture leg and the floor surface to facilitate moving. Unfortunately, dirt and debris on the floor surface can still be a problem. Essentially, the dirt and debris may become trapped beneath the glide or cap's lower surface and then be ground into the floor when the furniture is moved.

Attempts to address the problem of dirt and debris on the floor surface include U.S. Pat. No. 6,324,725, which discloses glides having "stipples," which are hemispherical, dot-like structures on the bottom of the glide. Unfortunately, even with the stipples of the '725 patent, dirt and debris on the floor may still collect in the space between the stipples as the furniture is moved across the floor surface. Also, as the stipples inevitably wear down the collection space diminishes, further capturing dirt and reducing the effectiveness of the glide. The arrangement of the stipples does not provide direct paths for the dirt and debris to travel beneath the moving glide. Accordingly, dirt and debris can build up in front of each stipple in a manner similar to the build-up of dirt and debris in front of a glide without stipples as the furniture is slid across a floor.

Further, in the glides and caps known in the art there is no indication of wear, making it difficult to objectively determine when replacement of the cap or glide is warranted. Therefore, in the prior art direct observation and subjective judgment is relied on to determine whether a cap or glide should be replaced.

Therefore, there is a need in the art for a cap or glide that facilitates moving furniture across a floor surface. There further exists a need in the art for a cap or glide that directs dirt and debris thereunder as the furniture is moved across the floor surface. There also exists a need for a cap or glide that includes a structure to permit objective determination of the degree of wear of the cap or glide.

SUMMARY OF THE INVENTION

The present invention is directed toward a cap or glide that facilitates moving furniture across a floor surface, and directs dirt and debris under the cap or glide as the furniture is moved across the floor surface. The present invention is further directed toward a cap or glide that permits objective determination of the degree of wear of the cap or glide.

In accordance with the present invention, a cap is cup-shaped and defines an axis, and has an upper surface, a lower surface, a sidewall, and a plurality of downwardly extending protrusions. The cap upper surface defines a receptacle that receives a bottom of a furniture leg. The plurality of protrusions extend or project downwardly from the cap lower surface, the protrusions including a plurality of outer protrusions and plurality of inner protrusions. The outer protrusions extend from the lower surface a predetermined first distance; the inner protrusions extend from the lower surface a predetermined second distance. The second distance is smaller than the first distance.

In further accordance with the invention, a furniture glide is provided. The glide is adapted to be secured to a bottom end of a furniture leg. The glide has a lower surface from which a plurality of protrusions extend. The protrusions include a plurality of outer protrusion and a plurality of inner protrusions. The outer protrusions extend from the lower surface a predetermined first distance; the inner protrusions extend from the lower surface a predetermined second distance. The second distance is smaller than the first distance.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
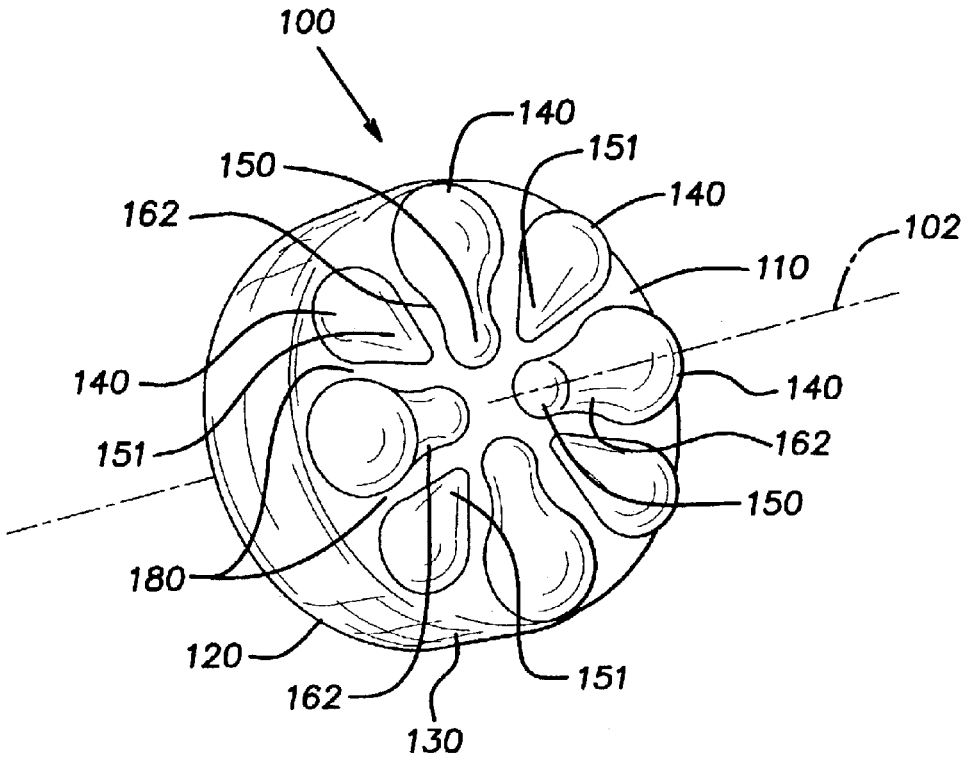
FIG. 1 is a perspective view of a cap in accordance with the present invention.
Figure 2:
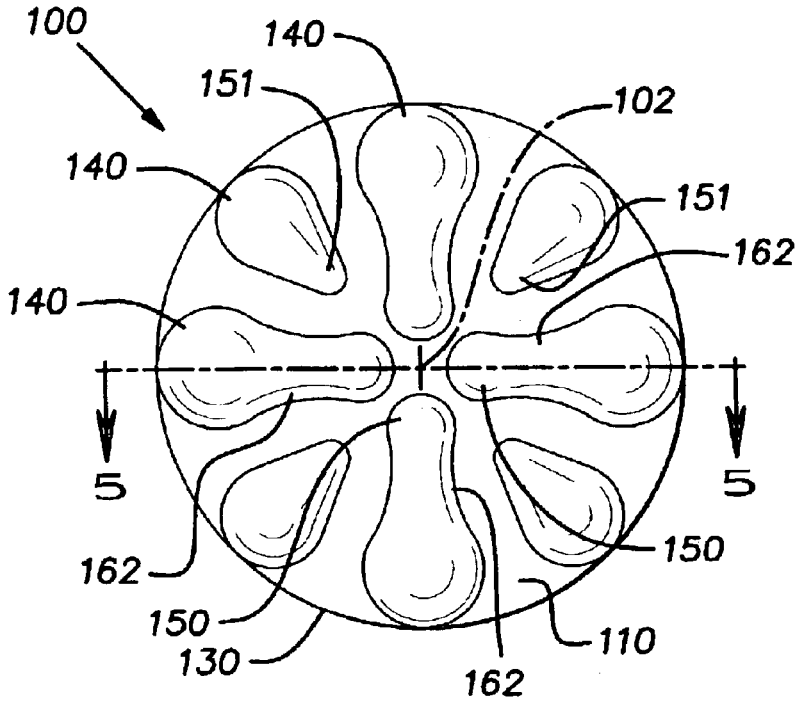
FIG. 2 is a bottom plan view of the cap shown in FIG. 1.
Figure 3:
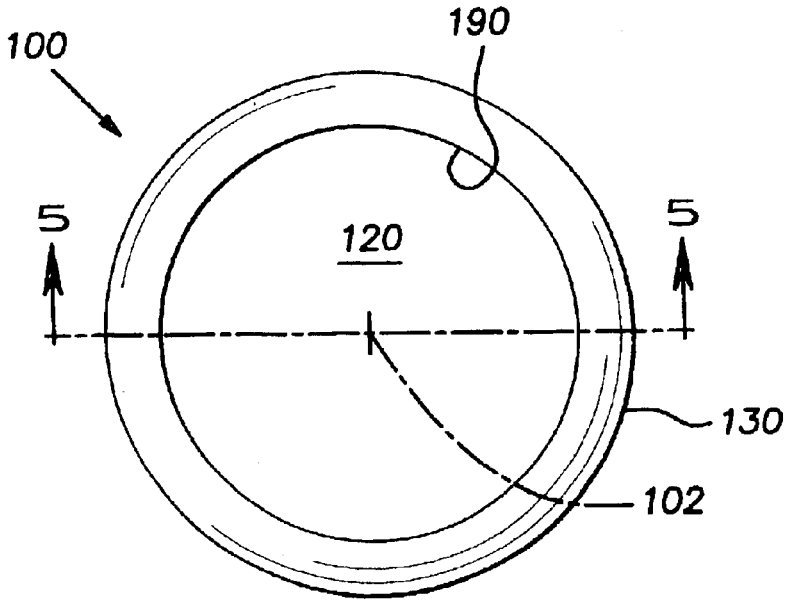
FIG. 3 is a top plan view of the cap shown in FIG. 1.
Figure 4:
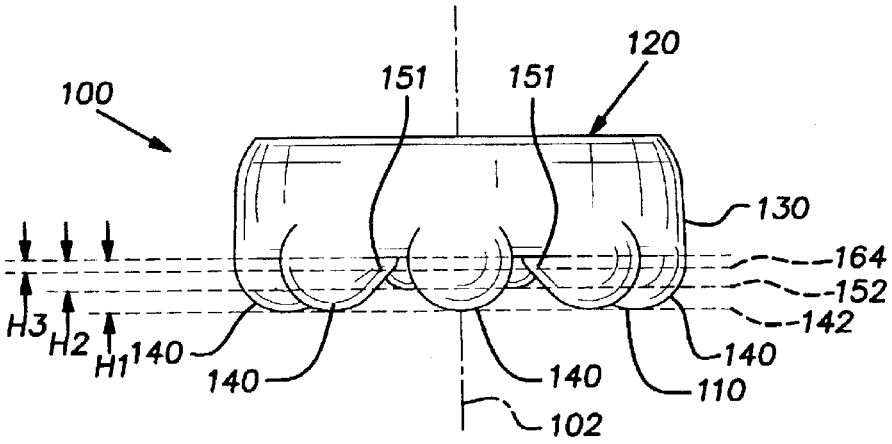
FIG. 4 is a side elevational view of the cap shown in FIG. 1.
Figure 5:
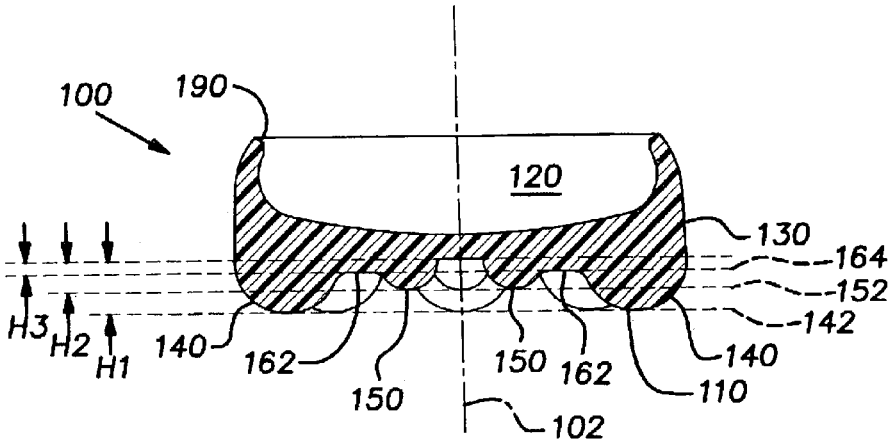
FIG. 5 is a cross-sectional view of the cap of FIGS. 1–4 taken along the line 5—5 shown in FIGS. 2–3.

A cap 100 in accordance with the present invention is shown in FIGS. 1–5. The cap 100 attaches to a bottom portion of a furniture leg to support an article of furniture, for example a chair, a table, a desk or the like. The cap 100 is thus disposed between the furniture leg and a floor surface upon which the furniture rests so as to facilitate movement of the furniture across the floor surface.

The cap 100 is generally circular, and defines an axis 102. The cap 100 has a generally planar lower surface 110, an upper surface 120, and a cylindrical sidewall 130, and is preferably formed of injection-molded polypropylene plastic. The cap upper surface and sidewall cooperate to define a cup-shaped receptacle that is adapted to receive the furniture leg, as is known in the art.

The lower surface 110 (FIG. 2) defines a plurality of first or outer protrusions 140 and a plurality of second or inner protrusions 150. The outer protrusions 140 are adjacent to the sidewall 130 and spaced from the axis 102. More particularly, the outer protrusions 140 form a generally circular array that is centered on the axis 102. The outer protrusions 140 are generally evenly spaced apart from each other, and are each about the same radial distance from the axis 102. The distal edges of the outer protrusions cooperate to define a first plane 142 that is generally perpendicular to the axis 102 and parallel to the lower surface 110, as shown best in FIGS. 4 and 5. The outer protrusions 140 thus extend outwardly from the lower surface 110 a predetermine distance or height H1.

Similarly, the inner protrusions 150 form a generally circular array that is centered on the axis 102 and disposed between the axis 102 and the array of outer protrusions 140. The distal edges of the inner protrusions define a second plane 152 that is generally perpendicular to the axis 102, parallel to the lower surface 110, and disposed between the lower surface 110 and the first plane 142. The inner protrusions 150 thus extend from the lower surface 110 a distance or height H2 that is less than the distance or height H1 of the outer protrusions 140.

In the preferred and illustrated embodiment, there are four inner protrusions 150, and each of the inner protrusions 150 is connected to a corresponding one of the outer protrusions 140 by a connector or saddle 162. The saddles 162 extend away from the lower surface 110 and have distal surfaces that cooperate to define a third plane 164, which is spaced a third distance or height H3 from the lower surface 110. The third distance H3 is less than the first and second distances H1, H2 of the outer or inner protrusions 140, 150, respectively. Thus, the third plane 164 is disposed between the lower surface 110 and the second plane 152, while the second plane 152 is disposed between the first plane 142 and the third plane 164.

In the preferred and illustrated embodiment, there are eight outer protrusions 140 and four inner protrusions 150. Thus, four of the outer protrusions 140 are connected to the four inner protrusions 150 by the saddles 162, as discussed hereinbefore, and the remaining four outer protrusions 140 are not connected to the inner protrusions 150. The outer protrusions 140 that are not connected to a corresponding inner protrusion 150 are generally teardrop shaped. More specifically, these outer protrusions are connected to an inwardly tapering portion 151 that extends radially inwardly and gently decreases in height until merging with the lower surface 110, as illustrated.

The outer and inner protrusions 140, 150, saddles 162, and the tapering portions 151 cooperate to define channels 180. The channels 180 are shaped and arranged to provide paths for dirt and debris to pass beneath the cap 100 as the furniture is moved or slid across a floor surface. Preferably, the arrays of the outer and inner protrusions 140, 150 are generally concentric circular rings. The concentric arrangement facilitates alignment of the channels 180 so that dirt and debris can pass through the channels in a generally linear direction. Alternative arrangements of the arrays include rings in which protrusions are staggered or offset relative to each other.

The upper surface 120 cooperates with the sidewall 130 to define a generally cup-shaped recess shaped to receive a bottom end of the furniture leg. A lip 190 extends radially inward from the sidewall 130 to further define the recess and to secure or snap-fit to the bottommost portion of the furniture leg. The lip 190 preferably has a beveled inner edge to facilitate or guide a furniture leg into the recess during installation.

The cap 100 is designed to be secured to the bottom end of a furniture leg. Generally, the cap 100 is disposed adjacent a bottom end of the furniture leg such that the upper surface 120 is facing the furniture leg end. The cap 100 is then pushed onto the leg such that the leg is received in the cap recess. The furniture leg is then set onto a floor surface with the cap 100 disposed between the leg and the floor, and the lower surface 110 facing toward the floor surface. The outer protrusions 140 engage the floor while the inner protrusions 150 and saddles 162 are vertically spaced from the floor surface.

During normal use, the furniture is moved across the floor. The cap 100 supports the furniture and the outer protrusions 140 slide along the floor surface. Dirt and debris on the floor surface pass under the cap lower surface 110 as the cap 100 is slid across the floor surface. In this regard it is noted that the protrusions 140, 150 and saddles 162 are relatively rigid such that the protrusions and saddles are capable of supporting the furniture and expected load without deformation thereof.

Moving the furniture has the expected effect of wearing down the outer protrusions 140. As the outer protrusions 140 wear, the height of the outer protrusions 140 decreases such that, eventually, they are equal to the height of the inner protrusions 150. When the heights of the outer and inner protrusions 140, 150 are equal, the outer and inner protrusions 140, 150 will both contact the floor surface, while the saddles 162 remain vertically spaced from the floor surface.

The outer and inner protrusions 140, 150 continue to wear during use. As the heights of the outer and inner protrusions 140, 150 further decrease, they eventually are equal to the height of the saddles 162. When the heights of the outer and inner protrusions 140, 150 are about equal to the height of the saddle 162, the saddles 162 also contact the floor surface.

The progressive wear of the protrusions 140, 150 serves as objective indication of whether the cap 100 should be replaced. For example, it may be determined that the cap should be replaced when the height of the outer protrusions 140 is equal to that of the inner protrusions 150. Alternatively, it may be determined that the cap 100 should be replaced when the height of the inner and outer protrusions 150, 140 is equal to the height of the saddles 162. When it is determined that the cap 100 should be replaced, it is simply pulled off the furniture leg and a new cap 100 is installed on the furniture leg, as described hereinbefore.

Figure 6:
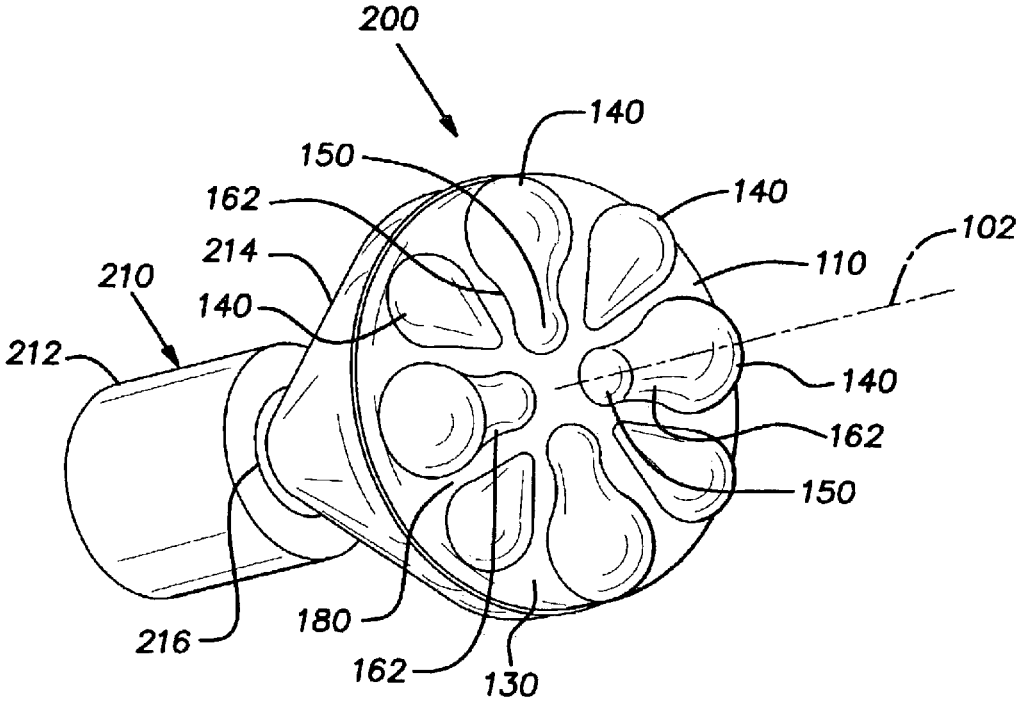
FIG. 6 is an elevated perspective view of a glide in accordance with the present invention.

A glide 200 according to a second embodiment of the invention is shown in FIG. 6. The glide 200 has many parts that are substantially the same as corresponding parts of the cap 100; this is indicated by the use of the same reference numbers in FIGS. 1 and 6. The glide 200 differs from the cap 100 in that the glide 200 does not itself snap-fit to the bottommost portion of the furniture leg, but rather has a fastener portion 210 that connects to the furniture leg.

The fastener portion 210 which, with the exception of the floor engaging portion described hereinbefore, is generally conventional, and includes a tubular leg portion 212 and a pivotably mounted cup-shaped portion 214 connected to the leg portion 212 by a swivel joint 216. The leg portion 212 of the fastener portion 210 includes an internal fastener (not shown), by means of which the fastener portion 210 is securely, but releasably, secured to the furniture leg. Various alternative methods for the attachment of glides to furniture legs are known to one of ordinary skill in the art.

The cup-shaped portion 214 defines an opening through which a floor-engaging portion having the lower surface 110 extends. Protrusions 140, 150 and saddles 162, as described hereinbefore, project from the lower surface. Thus, the glide 200 is disposed so that, initially, the outer protrusions 140 contact the floor while the inner protrusions 150 and the saddles 162 are vertically spaced from the floor.

Similarly to the cap 100, the glide 200 contacts the floor surface so that, when the article of furniture is slid across the floor, the outer protrusions 140 contact the floor surface. When the outer protrusions 140 are sufficiently worn, the inner protrusions 150 also contact the floor. Further, when the outer and inner protrusions 140, 150 are sufficiently worn, the saddles 162 contact the floor simultaneously with the outer and inner protrusions 140, 150 to increase the contact area with the floor surface.

When the glide 200 is worn, it may be removed from the furniture leg and replaced by a new glide 200, as is known in the art. Alternatively, the cap 100, described hereinbefore, may be snapped over the end of the glide 200 so as to cover the glide's worn lower surface with the cap 100.

Although the cap 100 and glide 200 is disclosed herein as being generally circular, in alternative embodiments, a cap or glide has a different general shape other than a disk shape. For example, the cap or glide may be oval, triangular, or square, in shape. Further, other different suitable materials and fabrication methods for producing the cap or glide are known to one of ordinary skill in the art. For example, the cap may be formed from a different plastic or polymer and the cap or glide may be produced by compression molding or machining, as appropriate. Because the shape or configuration of furniture legs varies from article of furniture to article of furniture, alternative caps and glides in accordance with the invention also vary so as to accommodate or conform to these different furniture leg configurations. For example, some furniture legs require a machine screw to attach to them, accordingly, an alternative cap or glide has a corresponding machine screw so as to attach to those furniture legs. Other alternative caps and glides can attach to furniture legs by spring-loaded clips, inserts, flanged inserts, sleeves, threads, T-nuts, nails and the like.

In other alternative embodiments, the number of outer and inner protrusions 140, 150 differs, but is generally at least three of each. Additionally, the ratio of saddle-connected to saddle-unconnected outer protrusions 140 differ in other alternative embodiments.

In yet another embodiment in accordance with the invention, a first colored pigment is used to color a portion of a cap or glide and a second colored pigment is used to color outer and inner protrusions on the cap or glide. The first and second pigments are used as layers such that the first layer hides the second layer when the cap or glide is new and unused, but when the cap or glide has worn a predetermined amount, the second layer is visible to provide a visual indication that the cap or glide should be placed.

While the preferred embodiments have been described and illustrated herein with particularity, it is considered apparent that the present invention is not limited thereto. Rather as noted hereinbefore, with knowledge of the preferred embodiments, one skilled in the art will be capable of various modifications, rearrangements, and substitutions of parts without departing from the scope and spirit of the present invention. Accordingly, the invention is not limited to the preferred embodiments described herein, but rather is only to be defined by the claims appended hereto.

What is claimed:

1. A floor-engaging device that is adapted to be secured to a furniture leg, the device including a lower surface having a plurality of protrusions extending therefrom, said plurality of protrusions including a plurality of first protrusions and a plurality of second protrusions, said first protrusions extending away from the lower surface a first predetermined distance while said second protrusions extend away from the lower surface a second predetermined distance, said first predetermined distance being generally greater than said second predetermined distance.

2. The device according to claim 1, wherein the first protrusions generally surround said second protrusions.

3. The device according to claim 2, wherein the plurality of first protrusions define a first array and the plurality of second protrusions define a second array, said first and second arrays being concentric with one another.

4. The device according to claim 3, wherein said cap defines an axis and each of the first protrusions is spaced a first radial distance from the axis.

5. The device according to claim 4, wherein each of said second protrusions is spaced a second radial distance from the axis, said second radial distance being less than said first radial distance.

6. The device according to claim 1, further comprising a connector extending between one of said first protrusions and one of said second protrusions, said connector extending from said lower surface a third predetermined distance, said third predetermined distance being less than said second predetermined distance.

7. The device according to claim 1, further comprising a plurality of connectors, each of said plurality of connectors extending between one of said first protrusions and one of said second protrusion, said connectors extending from said lower surface a third predetermined distance, said third predetermined distance being less than said second predetermined distance.

8. The device according to claim 7, wherein said first protrusions, second protrusions, and connectors cooperate to define channels through which dirt or debris may pass as the device is moved across a floor surface.

9. The device according to claim 1, wherein the first and second protrusions cooperate to provide visual indication of wear of the device during use.

10. The device according to claim 1, wherein the device is formed from a first material having a first color and a second material having a second color, said first material covering said second material such that, when the first material is worn away during use, the second material is revealed to indicate a predetermined amount of wear.

11. The device according to claim 1, wherein the device is a cap.

12. The device according to claim 1, wherein the device is a glide.

13. A method for repairing an article of furniture having a glide for contacting a floor, the method comprising:

providing a cap having a lower surface and an upper surface, said upper surface defining a receptacle for receipt of the glide;

forming a plurality of protrusions on said lower surface of said cap, said plurality of protrusions including a plurality of first protrusions and a plurality of second protrusions, said first protrusions extending away from the lower surface a first predetermined distance while said second protrusions extend away from the lower surface a second predetermined distance, said first predetermined distance being generally greater than said second predetermined distance; and, inserting said glide into the receptacle.

14. A method for repairing an article of furniture having a glide for contacting a floor, the method comprising:

removing the glide from the article of furniture;

providing a new glide having a lower surface, said lower surface having a plurality of protrusions formed thereon, said plurality of protrusions including a plurality of first protrusions and a plurality of second protrusions, said first protrusions extending away from the lower surface a first predetermined distance while said second protrusions extend away from the lower surface a second predetermined distance, said first predetermined distance being generally greater than said second predetermined distance; and, attaching said new glide to said article of furniture.

* * * * *